United States Patent [19]

Son

[11] Patent Number: 5,038,073

[45] Date of Patent: Aug. 6, 1991

[54] ELECTRON GUN FOR CATHODE RAY TUBE

[75] Inventor: Wan-jae Son, Cheonan, Rep. of Korea

[73] Assignee: Samsung Electron Devices Co., Ltd., Rep. of Korea

[21] Appl. No.: 438,870

[22] Filed: Nov. 20, 1989

[30] Foreign Application Priority Data

Dec. 23, 1988 [KR] Rep. of Korea ..... 88-21340

[51] Int. Cl.[5] ..... H01J 29/50; H01J 29/46; H01J 29/62

[52] U.S. Cl. ..... 313/414; 313/412; 313/433; 313/460

[58] Field of Search ..... 313/414, 412, 432, 433, 313/437, 458, 460

[56] References Cited

U.S. PATENT DOCUMENTS

| | | | |
|---|---|---|---|
| 3,987,329 | 10/1976 | Yamazaka et al. | 313/414 X |
| 4,253,041 | 2/1981 | Blacker et al. | 313/314 X |
| 4,400,649 | 8/1983 | Chen | 313/314 |
| 4,517,488 | 5/1985 | Say | 313/414 |
| 4,622,491 | 11/1986 | Izumida et al. | 313/414 |
| 4,626,738 | 12/1986 | Gerlach | 313/414 X |
| 4,686,420 | 8/1987 | Kamohara | 313/414 |
| 4,736,133 | 4/1988 | Barbin et al. | 313/414 |

OTHER PUBLICATIONS

Hecht, "Optics", 1987, pp. 186–188, 220–229.

*Primary Examiner*—Donald J. Yusko
*Assistant Examiner*—Brian Zimmerman
*Attorney, Agent, or Firm*—Leydig, Voit & Mayer

[57] ABSTRACT

An electron gun for a cathode ray tube includes a cathode, control grid, a screen grid, and an opposed anode and focus electrode for controlling and accelerating a plurality of electron beams, the anode and the focus electrode including recesses containing aligned central beam passing holes and pairs of peripheral beam passing holes on opposite sides of the central beam passing holes. The peripheral beam passing holes are intersected by planes of the recesses that are inclined relative to the electron beam passing direction.

5 Claims, 2 Drawing Sheets

ELECTRON GUN FOR CATHODE RAY TUBE

FIELD OF THE INVENTION

The present invention relates to an electron gun for a cathode ray tube and, particularly, to an electron gun including a final accelerating and focusing lens having low spherical aberration and low astigmatism.

BACKGROUND OF THE INVENTION

If the spherical aberration of the electron lenses in an electron gun is to be improved, the intensity of the electric field of the main lens has to be weakened, and at the same time, the diameter thereof has to be expanded. However, the diameter of the lens is restricted by the diameter of the neck of the cathode ray tube, and therefore, the range of improvement in the spherical aberration achievable through an increase of the diameter of the lens is very limited.

At present, therefore, a main lens consisting of a plurality of electron lenses generating relatively weak electric field intensities that overlap one another are used. Such a main lens means is disclosed in U.S. Pat. No. 4,253,041 and illustrated in FIG. 1, and constitutes a part of a multistep focusing type electron gun.

In FIG. 2, another type of electron gun, which is disclosed in U.S. Pat. No. 3,772,554, is shown. In that gun, the diameter of the main lens, constituting the final accelerating and focusing portion of the main lens, may be increased by providing a concave recess where beam passing holes are formed. This arrangement achieves the same effect as where a plurality of electron lenses are overlapped, as in the multistep focusing type electron gun described above. However, such an electron gun presents manufacturing difficulties because of the complicated press die required to make the beam passing holes.

SUMMARY OF THE INVENTION

The present invention is intended to overcome the above described disadvantages of the conventional techniques.

Therefore, it is the object of the present invention to provide an electron gun for a cathode ray tube in which the structure is simple, manufacturing is convenient, and spherical aberration and the astigmatism are improved to an efficient level.

To accomplish the above object, the electron gun for cathode ray tube according to the present invention is provided with recessed portions having inclined faces both on the beam passing plane of an anode and on the beam passing plane of the focusing electrode forming the final accelerating and focusing lens of the main lens wherein the central beam passing hole is disposed in the bottom of the recess and the peripheral beam passing holes are disposed in inclined faces of the recess, the central beam passing hole is smaller in diameter than the peripheral beam holes, and the circumferential lip of the central beam passing hole is shorter than circumferential lips of the peripheral beam passing holes.

Although the central beam passing hole has a smaller diameter, the distance between the main beam passing holes is relatively large. Therefore, the electron beams passing through the electron lens formed by the central beam passing hole experience small focusing forces thereby having decreased spherical aberration. Meanwhile, the electron beams passing through the electron lens formed by the peripheral beam passing holes also receive small focusing forces and have reduced spherical aberration, because the beam passing holes have larger diameters and a smaller distance to the next downstream beam passing hole.

Further, all or a part of the peripheral beam passing holes are inclined which is advantageous for converging the beams. That is, the electric fields are established in an inclined direction relative to the advancing direction of the electron beams by the inclined peripheral beam passing holes, and therefore, the beam coverging directions become uniform, with the result that the astigmatism for the peripheral electron beams is reduced.

BRIEF DESCRIPTION OF THE DRAWINGS

The above object and other advantages of the present invention will become more apparent by describing in detail a preferred embodiment of the present invention with reference to the attached drawings in which.

DESCRIPTION OF THE PREFERRED EMBODIMENT

Figure 1:
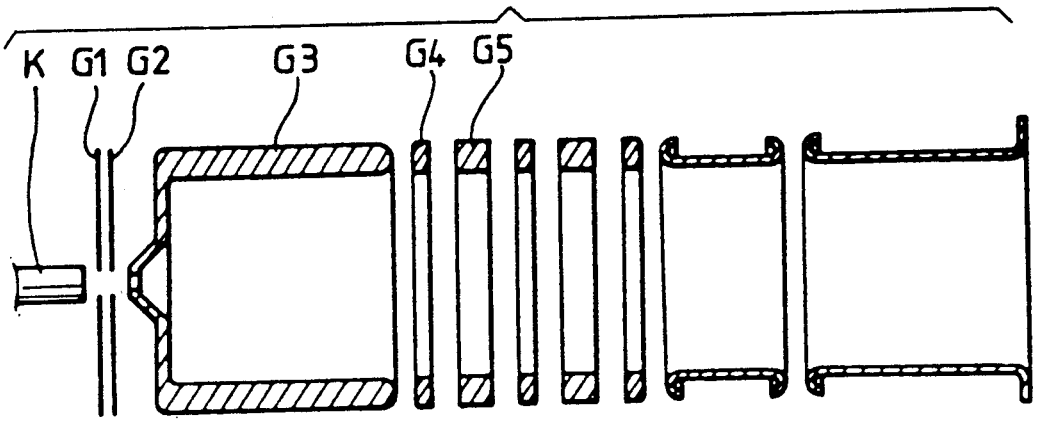
FIG. 1(Prior Art)
FIGS. 1 and 2 illustrate conventional electron guns.
Figure 2:
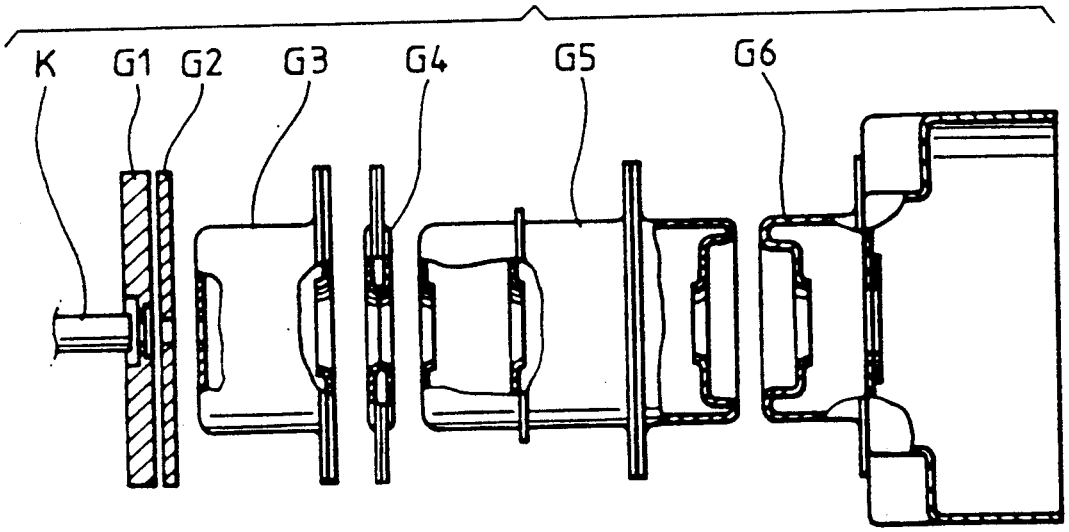
FIG. 2(Prior Art)
Figure 3:
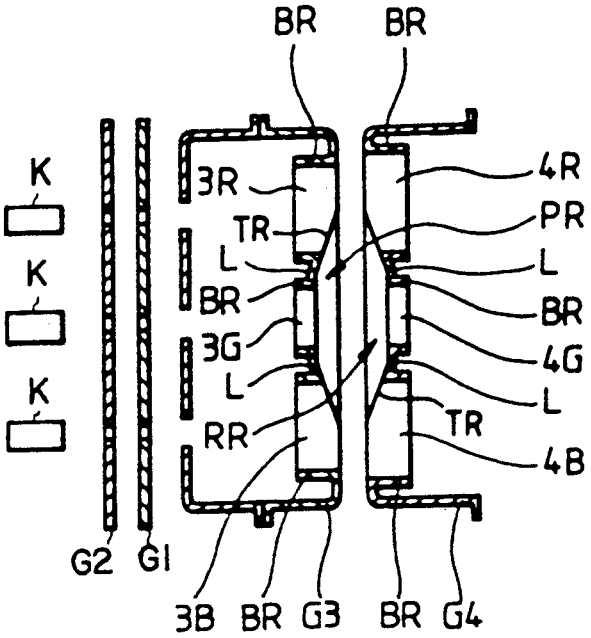
FIG. 3 illustrates a preferred embodiment of the electron gun according to the present invention.
Figure 4:
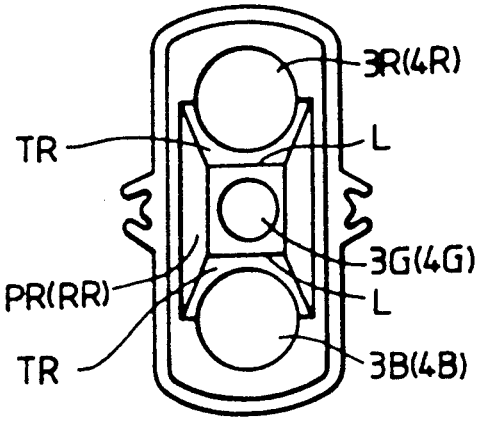
FIG. 4 is a plan view of an electrode comprising the major lens of the main lens illustrated in FIG. 3.

FIG. 3 illustrates the single lens type electron gun according to the present invention, which comprises a cathode K, a control grid G1, a screen grid G2, a focus electrode G3, and an anode G4.

Recessed portions PR and RR having an inclined face TR are respectively formed relative to the beam outgoing plane of the focus electrode G3, and relative to the beam incoming plane of the final accelerating electrode G4. The electrode G3 and G4 together form the main lens. Central beam passing holes 3G and 4G are respectively disposed at the centers of the recesses PR and RR, and peripheral beam passing holes 3R,3B, and 4R,4B are respectively disposed on opposite sides of the central beam passing holes 3G and 4G, respectively. The peripheral beam passing holes 3R, 3B 4R, and 4B are positioned on faces TR that are inclined relative to the beam direction. The inclined faces TR extend from the centers of the respective peripheral beam passing holes 3R,3B,4R,4B to the boundaries L between the central beam passing holes 3G and 4G and the peripheral beam passing holes 3R,3B,4R,4B.

However, the inclined faces TR can also be formed such that they extend from the boundaries L to edges of the gun so that the peripheral beam passing holes have fully inclined faces TR. Meanwhile, the central beam passing holes 3G and 4G have small diameters compared with the diameters of the peripheral beam passing holes 3R,3B,4R,4B. .The lengths of lips BR formed around the circumference of the central beam passing holes 3G,4G are shorter than the average length of the circumferential lips BR of the peripheral beam passing holes.

The electron gun of the present invention constituted as above will now be described as to the characteristics of its electron beams.

First, the electron beams passing through the electron lens formed by the central beam passing holes 3G,4G experience small focusing forces, and therefore, produce small spherical aberrations, because the gap between the opposing beam passing holes 3G,4G is relative large, although the diameters of those holes are relatively small. Meanwhile, the electron beams passing through the electron lens formed by the peripheral beam passing holes 3R,4R,3B,4B also experience small focusing forces, and therefore, produce small spherical aberrations, because, although the diameters of the lens-forming peripheral holes are relatively large, the separations between the peripheral beam passing holes are relatively small.

Figure 5:
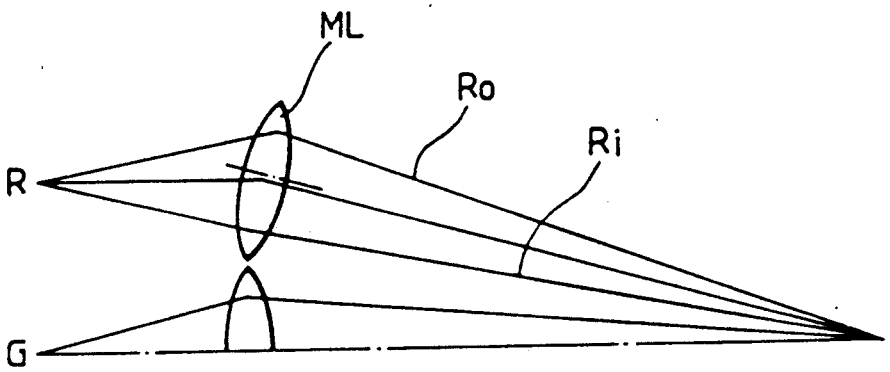
FIG. 5 visually illustrates the focused state and the converged state of the electron beams which are controlled by an electron gun according to the present invention.

Further, a part or all of the peripheral beam passing holes are inclined relative to the beam advancing direction, and therefore, convergence of beams can be advantageously carried out, while the focusing directions for the beam fluxes become uniform. This can be described more specifically in the following manner. As shown in FIG. 5 where the focused state and the converged state of the electron beam passing through the peripheral lens ML are illustrated, when the peripheral electron beams pass through the inclined peripheral main lens ML, the beam flux Ro at the outside of the lens ML experiences weak diverging forces, and therefore, experiences large deflecting angles. Meanwhile the beam flux Ri at the inside of the lens ML experiences strong diverging forces, but small deflecting angles because of the beam direction. Accordingly, the beam fluxes are controlled under the above described conditions to have a focus point, with the result that the beam spots form circular shapes.

The electron gun of the present invention described above is simple in its structure, and reduces the spherical aberrations and astigmatisms of the electron beams, thereby eliminating the necessity of an aberration correcting means of the conventional electron guns and improving the image quality and reliability of the cathode ray tube.

What is claimed is:

1. An electron gun for a cathode ray tube comprising:

a cathode, a control grid, a screen grid for generating a plurality of electron beams; and an opposed anode and focus electrode for controlling and accelerating the plurality of electron beams wherein said anode and focus electrode respectively include a central beam passing hole and a pair of peripheral beam passing holes disposed on opposite sides of the central beam passing holes, the respective central and peripheral beam passing holes in the anode and focus electrode being aligned for passage of respective electron beams, the anode and focus electrode each including a centrally disposed recess, the recesses being oppositely directed and each having a central portion including the respective central beams passing hole and two oppositely directed inclined portions inclined relative to the electron beam direction, the inclined portions extending from the central portions of the respective recesses toward the respective peripheral beam passing holes and intersecting at least part of the respective peripheral beam passing holes so that the central beam passing holes of said anode and focus electrode are farther apart than the respective peripheral beam passing holes of said anode and focus electrode.

2. The electron gun of claim 1 wherein the beam passing holes are circular and the central beam passing holes have smaller diameters than the peripheral beam passing holes.

3. The electron gun of claim 1 wherein said inclined portions intersect all of the peripheral beam passing holes.

4. The electron gun of claim 1 wherein said anode and focus electrode include oppositely projecting circumferential lips projecting from the central and peripheral beam passing holes and the lips adjacent the main passing holes project a shorter distance than the average projection of the lips adjacent the peripheral beam passing holes.

5. The electron gun of claim 1 wherein the central beam passing holes are more widely separated from each other than are the respective pairs of the peripheral beam passing holes.

* * * * *